United States Patent [19]

Nilssen

[11] Patent Number: 5,057,749

[45] Date of Patent: Oct. 15, 1991

[54] ELECTRONIC POWER FACTOR CORRECTION FOR BALLASTS

[76] Inventor: Ole K. Nilssen, Caesar Dr., Barrington, Ill. 60010

[21] Appl. No.: 377,225

[22] Filed: Jul. 10, 1989

Related U.S. Application Data

[63] Continuation-in-part of Ser. No. 60,027, Jun. 9, 1987.

[51] Int. Cl.[5] ..... H05B 41/00

[52] U.S. Cl. ..... 315/247; 315/209 R; 315/200 R; 315/283; 315/DIG. 5

[58] Field of Search ..... 315/247, 278, 209 R, 315/282, 284, DIG. 5, DIG. 7, 244, DIG. 2, 200 R, 218, 219, 224, 205; 363/132, 98; 323/206, 247

[56] References Cited

U.S. PATENT DOCUMENTS

| | | | |
|---|---|---|---|
| Re. 31,758 | 12/1984 | Nilssen | 331/113 A |
| 3,681,654 | 8/1972 | Quinn | 315/151 |
| 4,513,364 | 4/1985 | Nilssen | 315/219 X |
| 4,644,459 | 2/1987 | Nilssen | 363/133 |
| 4,727,470 | 2/1988 | Nilssen | 363/132 |
| 4,851,739 | 7/1989 | Nilssen | 315/278 |
| 4,862,040 | 8/1989 | Nilssen | 315/278 X |
| 5,001,400 | 3/1991 | Nilssen | 315/209 R |

*Primary Examiner*—Eugene R. Laroche
*Assistant Examiner*—Ali Neyzari

[57] ABSTRACT

In an inverter-type fluorescent lamp ballast adapted to be powered from a DC supply voltage consisting of a substantially non-filtered full-wave-rectified 60 Hz power line voltage, the inverter's output is a 120 Hz magnitude-modulated squarewave voltage of frequency controllable about 30 kHz. The magnitude-modulated squarewave voltage is applied across a series-connected high-Q L-C circuit. The fluorescent lamp is connected in parallel with the tank capacitor of this L-C circuit. The magnitude of the current drawn by the fluorescent lamp is a sensitive function of the frequency of the squarewave voltage and is controlled by correspondingly controlling the frequency of this squarewave voltage. By controlling the frequency of the squarewave voltage in synchronism with the 120 Hz DC ripple frequency and in such manner as to cause the magnitude of the lamp current to be roughly proportional to the instantaneous magnitude of the unfiltered DC supply voltage, the line current drawn by the electronic ballast from the power line will have a high power factor and a relatively low harmonic distortion.

12 Claims, 3 Drawing Sheets

ELECTRONIC POWER FACTOR CORRECTION FOR BALLASTS

RELATED APPLICATION

This application is a Continuation-in-Part of application Ser. No. 07/060,027 filed June 9, 1987.

BACKGROUND OF THE INVENTION

1. Field of Invention

The present invention relates to a series-resonant inverter-type fluorescent lamp ballast wherein inversion frequency is automatically controlled such as to control the magnitude of the output power.

2. Elements of Prior Art

In a power-line-operated electronic ballast for gas discharge lamps, one significant issue is that of making the ballast draw its power from the power line with a high power factor. A related issue is that of making the current drawn by the ballast from the power line have a minimum amount of harmonic distortion.

SUMMARY OF THE INVENTION

Objects of the Invention

A general object of the present invention is that of providing a cost-effective inverter-type ballast.

A more specific object is that of providing a power-line-operated electronic ballast operative to draw its power from the power line with a high power factor and with a low amount of harmonic distortion.

These, as well as other objects, features and advantages of the present invention will become apparent from the following description and claims.

BRIEF DESCRIPTION

In its basic preferred embodiment, the present invention constitutes a power-line-operated self-oscillating inverter-type fluorescent lamp ballast comprising:

a) a rectifier-filter arrangement operative to connect with a 60 Hz power line voltage and to provide a DC supply voltage at a pair of DC terminals, the instantaneous magnitude of the DC supply voltage being equal to the larger of: (i) the absolute instantaneous magnitude of the power line voltage; and (ii) the magnitude of a DC auxiliary voltage obtained from an energy-storing capacitor, the magnitude of which auxiliary voltage is substantially constant at approximately 40% of the absolute peak magnitude of the power line voltage;

b) a half-bridge inverter connected with the DC terminals and operative to provide a squarewave output voltage at a pair of inverter terminals, the instantaneous magnitude of the squarewave output voltage being proportional to that of the DC supply voltage;

c) a high-Q L-C series-combination connected across the inverter's output terminals, this L-C series-combination having a natural resonance frequency;

d) load means, including a fluorescent lamp and charging means for the energy-storing capacitor, connected in circuit with the tank capacitor of the L-C series-combination, the amount of power being drawn by the load means being dependent on the instantaneous magnitude of the DC supply voltage as well as on the frequency of the inverter's squarewave output voltage;

e) feedback means being: (i) connected in circuit with the inverter's output; (ii) responsive to the inverter's output current; and (iii) operative to cause inverter self-oscillation at or near the natural resonance frequency of the L-C series-combination; and (f) frequency control means connected in circuit with the feedback means and operative, in response to a control current, to control the instantaneous magnitude of the current drawn by the ballast from the DC supply voltage, thereby to aid in reducing the harmonic distortion of the current drawn by the ballast from the power line while at the same time providing for an acceptably low crest factor of the current provided to the fluorescent lamp.

As an overall result, the ballast draws no current at all from the power line between 0–24 degrees and between 156–180 degrees of each half-cycle of the power line voltage; and draws current roughly in a sinusoidal manner between 24–156 degrees of each such half-cycle. The resulting power factor is over 95% and the total harmonic distortion is no higher than about 20%.

DESCRIPTION OF THE PREFERRED EMBODIMENT

Figure 1:
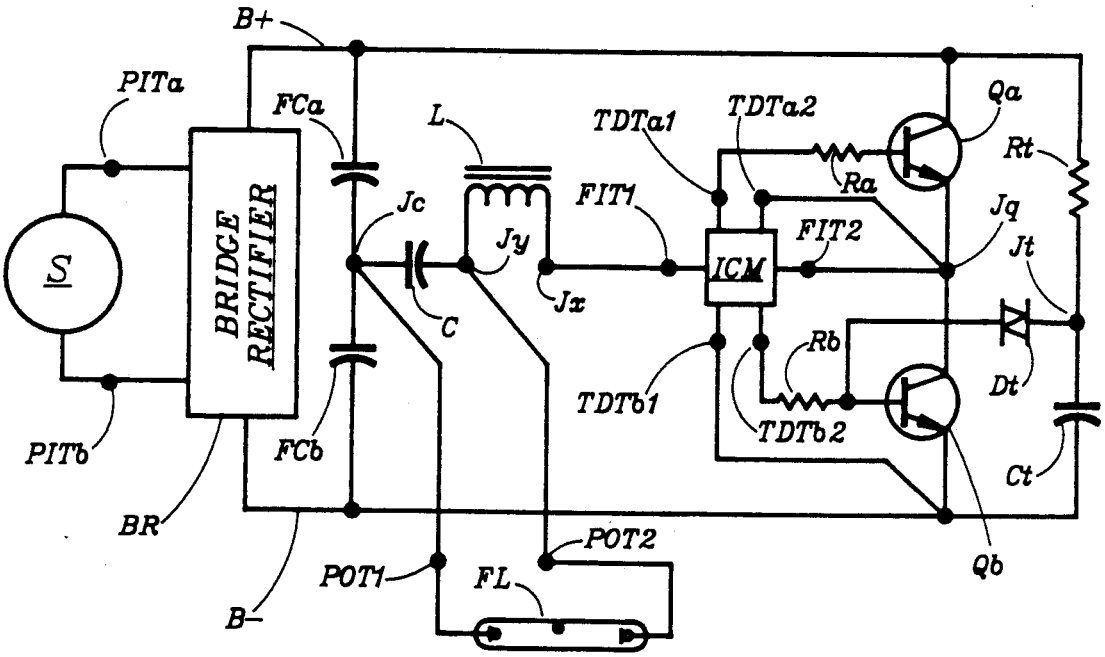
FIG. 1 represents a basic electrical circuit diagram of a frequency-controlled electronic ballast.
Figure 2:
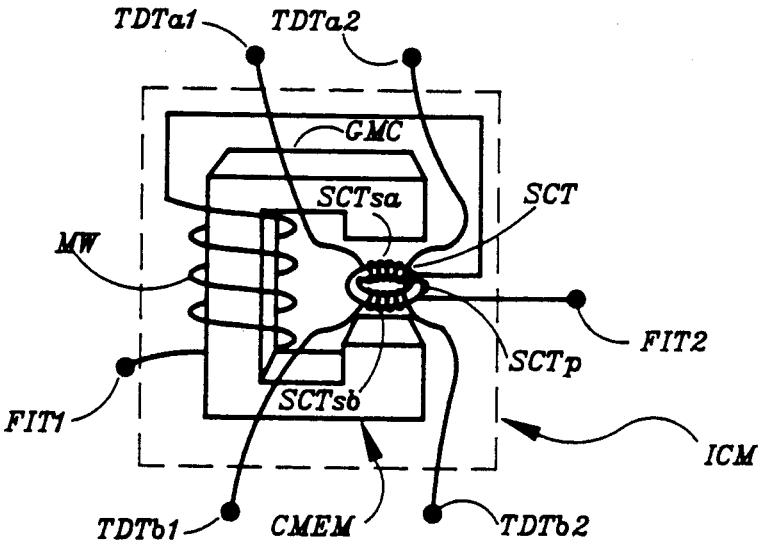
FIG. 2 provides a detailed view of the frequency control means, including the saturable current feedback transformer and the adjacently positioned cross-magnetizing electro-magnet.

Details of Construction re FIGS. 1 and 2

FIG. 1 schematically illustrates the electrical circuit arrangement of a frequency-controlled electronic ballast.

In FIG. 1, a source S of ordinary 120 Volt/60 Hz power line voltage is applied to power input terminals PITa and PITb; which terminals, in turn, are connected with a bridge rectifier BR. The DC output from bridge rectifier BR is applied to a B+ bus and a B− bus, with the B+ bus being of positive polarity.

A first filter capacitor FCa is connected between the B+ bus and a junction Jc; and a second filter capacitor FCb is connected between junction Jc and the B− bus.

A first switching transistor Qa is connected with its collector to the B+ bus and with its emitter to a junction Jq.

A second switching transistor Qb is connected with its collector to junction Jq and with its emitter to the B− bus.

An inverter control means ICM has a pair of feedback input terminals FIT1 and FIT2, a first pair of transistor drive terminals TDTa1 and TDTa2, and a second pair of transistor drive terminals TDTb1 and TDTb2.

Input terminals FIT1 and FIT2 are respectively connected with junction Jq and a junction Jx; transistor drive terminals TDTa1 and TDTa2 are respectively connected with the base and the emitter of transistor Qa by way of a base-current-limiting resistor Ra; transistor drive terminals TDTb1 and TDTb2 are respectively connected with the emitter and the base of transistor Qb by way of a base-current-limiting resistor Rb.

A capacitor C is connected between junction Jc and a junction Jy; and an inductor L is connected between junctions Jy and Jx. Junctions Jc and Jy are respectively connected with power output terminals POT1 and POT2; across which output terminals is connected a fluorescent lamp FL.

A resistor Rt is connected between the B+ bus and a junction Jt; a capacitor Ct is connected between junction Jt and the B− bus; and a Diac Dt is connected between junction Jt and the base of transistor Qb.

FIG. 2 provides details of inverter control means ICM.

In FIG. 2, a saturable current transformer SCT has: i) a primary winding SCTp, ii) a first secondary winding SCTsa connected between the first pair of transistor drive terminals TDTa1 and TDTa2, and iii) a second secondary winding SCTsb connected between the second pair of transistor drive terminals TDTb1 and TDTb2.

A cross-magnetizing electro-magnet CMEM has a gapped magnetic core GMC; and saturable current transformer SCT is positioned within the gap thereof.

Gapped magnetic core GMC has a magnetizing winding MW; which magnetizing winding is connected in series with primary winding SCTp of saturable current transformer SCT to form a series-combination; and this series-combination is connected between first and second feedback input terminals FIT1 and FIT2.

Details of Operation re FIGS. 1 and 2

The operation of the half-bridge inverter of FIG. 1 is conventional and is explained in conjunction with FIG. 8 of Nilssen U.S. Pat. No. 31,758. However, as indicated in FIG. 2, only a single saturable current feedback transformer is used instead of the two saturable current feedback transformers shown in Nilssen's FIG. 8. The resulting difference in operation is of no consequence in connection with the present invention.

Due to the resonance-effect of the high-Q L-C circuit, the magnitude of the current flowing into the L-C circuit is a sensitive function of the inverter's oscillating frequency, especially when the L-C circuit is unloaded. In turn, the inverter's oscillating frequency is dependent on the magnetic flux saturation characteristics of the magnetic core of the saturable current transformer SCT; which saturable current transformer is used in the positive feedback circuit of the self-oscillating inverter.

Details in respect to the effect of the magnetic flux saturation characteristics on the inverter's oscillation frequency are provided in Nilssen U.S. Pat. No. 4,513,364.

Specifically, as the saturation flux density of the saturable current transformer is reduced, the inverter's oscillation frequency increases—and vice versa.

One way of reducing the transformer's saturation flux density is that of increasing the temperature of the ferrite magnetic core used in that transformer; which effect is further explained in Nilssen U.S. Pat. No. 4,513,364.

Another way of reducing the transformer's saturation flux density is that of subjecting the transformer's ferrite magnetic core to a cross-magnetizing flux, such as from an adjacently placed permanent magnet or electro-magnet. That way, the saturation flux density of the transformer's ferrite magnetic core decreases with increasing cross-magnetizing flux.

With reference to FIGS. 1 and 2, the detailed operation of the inverter's frequency control feature may be understood as follows.

a) When saturable current transformer SCT is not subjected to a cross-magnetizing field, the ON-time of each transistor (Qa/Qb) will be determined by the time it takes for the magnetic core in SCT to saturate due only to the saturating effect resulting from the current flowing through its primary winding SCTp. This saturating effect, in turn, results from the magnitude of the voltage developing across its primary winding as integrally combined with the length of time that this voltage is present thereacross (i.e., the integral number of Volt-seconds). Thus, for a given magnetic core and number of turns on the primary winding, whenever a certain given amount of Volt-seconds has been accumulated across this primary winding, saturation occurs.

With the resistance of resistors Ra/Rb negligibly small—as is ordinarily the case in other self-oscillating inverters with current feedback—the magnitude of the voltage developing across primary winding SCTp as a result of current flowing through it is substantially independent of the magnitude of this current. (This is so because the magnitude of the base-emitter voltage of each of transistors Qa/Qb is essentially constant as long a forward base current is flowing.) Thus, the length of time it takes for transformer SCT to reach saturation is essentially constant, regardless of the magnitude of the current flowing through its primary winding.

As a net overall result, the frequency of oscillation of the inverter will be substantially unaffected by the magnitude of the current drawn from its output.

b) However, with the resistance of resistors Ba/Rb not being negligibly small, the magnitude of the voltage developing across primary winding SCTp will not be independent of the magnitude of the current flowing through this primary winding. On the contrary, the magnitude of the voltage developing across the primary winding will now be a sensitive function of the magnitude of the current flowing therethrough.

Thus, with resistors Ra/Rb having significant resistance values, the length of time it will take for transformer SCT to saturate will become shorter as the magnitude of the current flowing through its primary winding increases; which is to say that the ON-time of each transistor will become shorter as the current drawn from the inverter's output increases in magnitude.

As an overall net result, the frequency of oscillation of the inverter will increase in proportion to the magnitude of the current drawn from the inverter's output.

c) When saturable current transformer SCT is subjected to a cross-magnetizing field, the effects are more complex and harder to understand. However, a good degree of understanding may be achieved by considering an ideal situation where resistors Ra/Rb have negligible resistance values and where the amount of Volt-seconds accumulated across primary winding SCTp has negligible effect on saturation. Under these conditions, transformer SCT will provide for positive feedback until the magnitude of the current flowing through magnetizing winding MW reaches the point at which the cross-magnetizing field causes the magnetic core of transformer SCT to become saturated; at which point transformer SCT will cease to provide output current.

In other words, when being cross-magnetized as a direct function of the magnitude of the inverter's output current, each transistor will remain in its ON-state only long enough for the current through it to reach a given magnitude; at which point its base drive will be removed as a result of the core of the feedback transformer having become saturated.

As a net overall result, the frequency of oscillation of the inverter will be whatever is required to limit the peak magnitude of the inverter's output current to a given level. Thus, with feedback controlled by cross-magnetization as herein described, the peak magnitude of the current available from the inverter's output will be substantially constant.

d) Under the condition where resistors Ra/Rb have negligible resistance values, but where saturable current transformer SCT saturates under the combined influence of the cross-magnetizing field as well as the Volt-second integral accumulating across its primary winding, the net overall results will be:

i) for low levels of inverter output current, the inverter's oscillating frequency will essentially be determined by the Volt-second integral cumulated across primary winding SCTp, and will therefore be substantially constant;

ii) as the magnitude of the inverter output current increases, the inverter's oscillation frequency will eventually start to increase along with the magnitude of the inverter output current; until iii) a point is reached at which the magnitude of the inverter's output current can not be increased any longer, and where the inverter's oscillation frequency will simply increase enough to prevent the output current from increasing any further.

In view of the above explanations, the frequency-controlling features of the circuit represented by FIGS. 1 and 2 will be understood to be as follows.

e) With the inverter oscillating at the natural resonance frequency of the unloaded L-C series-circuit, and with fluorescent lamp FL non-connected or non-operative, the magnitude of the current flowing from the inverter's output would become exceedingly high after but a few cycles of oscillation. However, due to the effect of resistors Ra/Rb and/or the cross-magnetizing field, as the magnitude of the inverter's output current increases, the inverter's oscillating frequency will increase, thereby limiting the magnitude of the output current in a negative feedback manner.

The sharpness of the limitation on the magnitude of the output current will depend on the combination of the various parameters: the resistance values of resistors Ra/Rb; the magnitude of the current required by magnetizing winding MW to cause saturation of the magnetic core of transformer SCT by cross-magnetization; and the Volt-second integral required to be accumulated across the primary winding of transformer SCT before its magnetic core will saturate.

A significantly useful effect is attained even without the use of the cross-magnetizing field. However, a much more substantial effect is attained when using cross-magnetization.

Thus, with the unloaded L-C series-circuit connected across the inverter's output, the magnitude of the inverter's output current is prevented from reaching destructingly high levels. Rather, by proper choice of parameters, the magnitude of the output current can be made just so high as to cause the magnitude of the voltage developing across tank-capacitor C to reach a level appropriate for effective starting of the fluorescent lamp.

On the other hand, with the fluorescent lamp loading the L-C series-circuit, the magnitude of the current drawn from the inverter's output will be limited even if the inverter oscillates at or near the natural resonance frequency of the loaded L-C circuit.

Since the basic nature of fluorescent lamps is such that lamp starting voltage is much larger in magnitude than is lamp operating voltage, the overall result—in the circuit of FIG. 1—is such that the magnitude-limitation on the inverter output current will indeed have the desired effect of preventing circuit damage while providing for an adequately high lamp starting voltage, while constituting no limitations on regular lamp operation.

Or, as seen from another aspect angle, the magnitude of the current required to cause an adequately high lamp starting voltage to develop across capacitor C is much larger than that of the current required to develop across C to provide for an adequately high lamp operating voltage. (In this context, the lamp operating current can be effectively ignored for the reasons that: i) it will be in quadrature with, and of magnitude similar to that of, the reactive current flowing through capacitor C; and ii) the frequency of inverter oscillation will be substantially lower during regular lamp operation.)

As a net overall result, the ballast circuit of FIG. 1 will permit the establishment of a situation where: i) after lamp ignition, when the fluorescent lamp operates in normal manner, the inverter's oscillating frequency is approximately equal to the natural resonance frequency of the loaded L-C circuit, which implies highly efficient operation in that the inverter's output current will be substantially in phase with its output voltage; and ii) before lamp ignition, or with no lamp connected, the inverter's oscillating frequency increases to a point of limiting the inverter's output current to a level just sufficient to cause a suitable lamp starting voltage to develop across capacitor C, at which point the inverter's output current will be about 90 degrees phase-delayed with respect to its output voltage.

Figure 3:
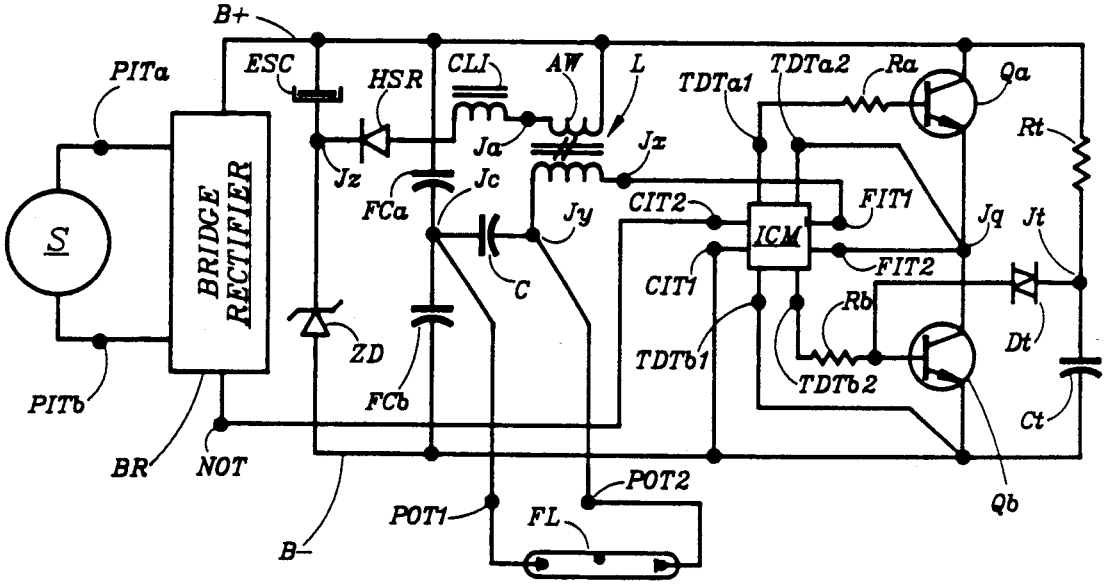
FIG. 3 represents a basic electrical circuit diagram of the preferred embodiment of the invention.
Figure 4:
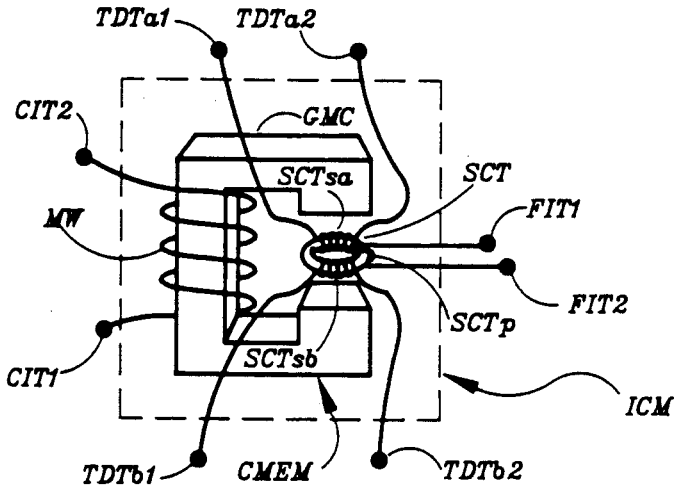
FIG. 4 provides a detailed view of the frequency control means as used in the circuit of FIG. 3.

Details of Construction re FIGS. 3 and 4

The circuit arrangement of FIG. 3 represents the preferred embodiment of the invention. An inverter control means ICM' of FIG. 3 corresponds to inverter control means ICM of FIG. 1 and is illustrated in FIG. 4.

The circuit arrangements of FIGS. 3 and 4 are the same as those of FIGS. 1 and 2, except for the following modifications.

1. In the arrangement of FIG. 4, primary winding SCTp of saturable current transformer SCT has been disconnected from magnetizing winding MW and is now connected directly between terminals FIT1 and FIT2. Magnetizing winding MW is connected between first and second contril input terminals CIT1 and CIT2.

2. In the arrangement of FIG. 3, control input terminals CIT1 and CIT2 of inverter control means ICM' is connected between the B− bus and the negative output terminal NOT of bridge rectifier BR.

3. An energy-storing capacitor ESC is connected between the B+ bus and a junction Jz; and a Zener diode ZD is connected between junction Jz and the B− bus—with the cathode of Zener diode ZD being connected with junction Jz.

3. An auxiliary winding AW is magnetically coupled with inductor L; and the terminals of winding AW is connected between the B+ bus and a junction Ja. A current-limiting inductor CLI is connected in series with a high speed rectifier HSR to form a series-combination; and this series-combination is connected between junctions Ja and Jz—with the cathode of rectifier HSR being connected with junction Jz.

4. The magnetic or inductive coupling between inductor L and auxiliary winding AW is relatively loose, thereby causing the output impedance of auxiliary winding AW to constitute a substantial inductive reactance. Depending on details of construction—that is, if the magnitude of the output inductance of AW is sufficiently large—current-limiting inductor CLI may be made quite small or even entirely eliminated.

Details of Operation re FIGS. 3 and 4

The operation of the circuit arrangement of FIG. 3 is the same as that of FIG. 1, except for the following differences.

5. Due to the modification of inverter control means ICM' of FIG. 3 versus inverter control means ICM of FIG. 1, the inverter's output current does not directly cause any cross-magnetization of the ferrite magnetic material in saturable current transformer SCT. Indirectly, however, the inverter's output current provides an effect similar to that associated with the circuit of FIG. 1. This is so for the reason that the magnitude of the inverter's output current in effect determines the magnitude of the inverter's input current; which input current, in turn, is used for affecting the inverter's oscillating frequency, thereby to control the magnitude of its output current.

More particularly, the unidirectional current flowing from bridge rectifier BR affects the inverter's frequency of oscillation in such manner as to prevent the magnitude of the unidirectional current flowing from bridge rectifier BR from exceeding some pre-determined level, thereby to provide protection against excessive inverter currents.

Figure 5:
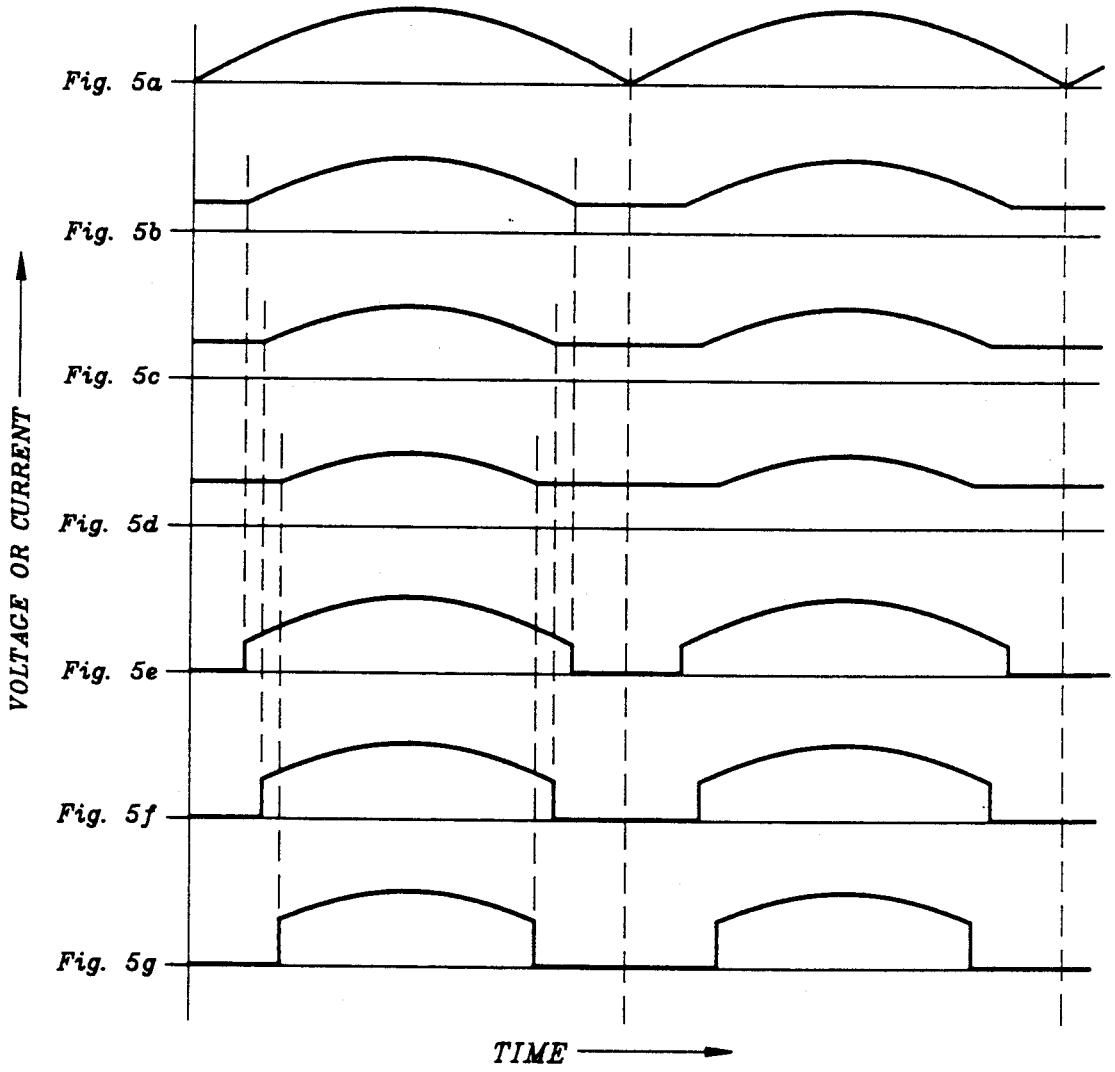
FIG. 5 illustrates various current and voltage waveforms pertinent to the operation of the circuit of FIG. 3.

6. The instantaneous magnitude of the DC supply voltage (i.e., the DC voltage present between the B− bus and the B+ bus) is as indicated by FIG. 5 for four different levels of voltage on energy-storing capacitor ESC.

As indicated by FIG. 5*a*, with the voltage on capacitor ESC being of zero magnitude, the instantaneous magnitude of the DC supply voltage is merely equal to the absolute instantaneous magnitude of the power line voltage provided at power input terminals PITa and PITb of bridge rectifier BR. Thus, with a 120 Volt/60 Hz power line voltage presented to those power input terminals, the DC supply voltage consists of sinusoidally-shaped voltage pulses of 120 Hz frequency and about 160 Volt peak magnitude.

As indicated by FIG. 5*b*, with the voltage on capacitor ESC being a substantially constant-magnitude 64 Volt, the instantaneous magnitude of the DC supply voltage will be the same as that of FIG. 5*a*, except for being manifestly prevented from going below 64 Volt.

FIGS. 5*c* and 5*d* illustrate corresponding waveforms for situations where the magnitude of the DC voltage on capacitor ESC is 80 and 96 Volt, respectively.

7. The magnitude of the DC voltage developing on capacitor ESC is determined by the magnitude of the 30 kHz (or so) voltage provided across auxiliary winding AW in combination with the magnitude of current-limiting inductor CLI.

The magnitude of this 30 kHz voltage, which varies in synchronism with the variations of the DC supply voltage, is so chosen as to cause charging of capacitor ESC to start approximately at the point where the magnitude of the DC supply voltage increases above that of the voltage on capacitor ESC.

The magnitude of the charging current provided to capacitor ESC, which also varies in synchronism with the variations of the DC supply voltage, is so chosen as to replace just as much energy onto capacitor ESC during each period when the magnitude of the DC supply voltage is larger than the voltage on capacitor ESC, as is taken out of capacitor ESC during each period when the magnitude of the DC supply voltage is equal to the voltage on capacitor ESC.

8. Of the different alternatives illustrated in FIGS. 5*a–d*: (i) the one of FIG. 5*a* is impracticable for the reason that the inverter will stop oscillating each time the magnitude of the DC supply voltage falls below 20 Volt or so, which would result in a lamp current of unacceptably high crest factor; (ii) the one of FIG. 5*b* represents the herein preferred situation, permitting the attainment of an acceptably low lamp current crest factor while at the same time resulting in acceptably low harmonic distortion of the current drawn from the power line; (iii) the one of FIG. 5*c* represents a situation that is relatively easy to attain, but which results in an undesirably high degree of distortion of the current drawn from the power line; and (iv) the one of FIG. 5*d* represents a situation that is particularly easy to obtain, but which results in an exceptionally high degree of harmonic distortion of the current drawn from the power line.

The waveshapes of the power line currents associated with the different DC supply voltages of FIGS. 5*b–d* are illustrated by FIGS. 5*e–g*, respectively.

The waveshape of FIG. 5*e* provides for a total harmonic distortion of about 17%; the one of FIG. 5*f* provides for a total harmonic distortion of about 24%; and the one of FIG. 5*g* provides for a total harmonic distortion of about 40%.

Each of the waveshapes of FIGS. 5*e–g* provides for a power factor over 85%; but the waveshape of FIG. 5*e* provides for a power factor in excess of 95%.

Additional Comments f) Detailed information relative to a fluorescent lamp ballast wherein the fluorescent lamp is powered by way of a series-excited parallel-loaded L-C resonant circuit is provided in Nilssen U.S. Pat. No. 4,554,487.

One effect of such a ballasting arrangement is that of making the waveshape of the voltage provided across the output to the fluorescent lamps very nearly sinusoidal, even though the output from the inverter itself, at the input to the series-resonant L-C circuit, is basically a squarewave.

g) In addition to preventing destructively high circuit currents and/or voltages, one important implication of controlling the magnitude of the inverter's output current as indicated by the arrangement of FIGS. 1 and 2 is that of providing for a high level of light output regulation: if the magnitude of the power line voltage were to change from its nominal value by a given percentage, the light output from the fluorescent lamp would change by a smaller percentage than otherwise would have been the case.

Another important implication of controlling the magnitude of the inverter's output current is that of being able to provide for improved lamp current crest factor.

(h) It is important to realize that the degree of inverter frequency control resulting from the indicated cross-magnetizing effect is a highly non-linear function of the magnitude of the DC control current flowing through magnetizing winding MW: a small amount of control current will not have any appreciable effect, while a somewhat larger amount of control current will have a substantial effect. Of course, the point at which the control current will start having a substantial effect is determined by the number of turns on the magnetizing winding.

(i) Of particular importance to realize is the fact that inverter control means ICM' permits ongoing or dynamic control of the inverter's oscillating frequency (i.e., inverter frequency modulation) and therefore permits corresponding dynamic control of the magnitude of the current drawn by the inverter—and therefore of the magnitude of the current drawn from the power line as well.

Thus, by modulating the magnitude of the control current provided to magnetizing winding MW (at a rate of 120 Hz), the instantaneous magnitude of the current drawn from the power line may be controlled correspondingly.

Similarly, the crest factor of the lamp current may be controlled.

On basis of the circuit arrangement of FIG. 3, and by choosing the magnitude of the DC voltage on capacitor ESC such as to yield the DC supply voltage of FIG. 5*b*, it is indeed possible to satisfy both the desire for maintaining a line current waveshape having harmonic distortion of less than about 20% (see FIG. 5*e*) as well as the desire for maintaining a lamp current crest factor not higher than about 1.7.

(j) As will be well understood by a person possessing ordinary skill in the art pertinent hereto, instead of merely subjecting magnetizing winding MW to the direct flow of the rectified power line current—which provides for a basic but very simple inverter frequency control function—a much more sophisticated control arrangement may be used. For instance, by suitable shaping of the control current, the inverter frequency may be modulated in exactly the manner required to simultaneously minimize both harmonic distortion and lamp current crest factor.

(k) With the inverter powering a fluorescent lamp while operating at a constant frequency, but without any inverter power being used for charging capacitor ESC, the current drawn from the power line would have been of roughly constant magnitude during the period of actual power line current flow. When the inverter is additionally used for charging capacitor ESC, there will be an additional component to the power line current; which additional component will cause the the power line current to assume a waveshape similar to those indicated by FIGS. 5*e–g*.

(l) It is believed that the present invention and its several attendant advantages and features will be understood from the preceeding description. However, without departing from the spirit of the invention, changes may be made in its form and in the construction and interrelationships of its component parts, the form herein presented merely representing the presently preferred embodiment.

I claim:

1. An arrangement comprising:

a source of substantially sinusoidal AC voltage;

full-wave rectifier connected with the source of AC voltage and operative to provide periodic pulses of unidirectional current to a pair of DC terminals across which there exists a main DC voltage;

load means connected with the DC terminals; the load means including inverter means and gas discharge lighting means; and auxiliary DC supply means connected in circuit between the inverter means and the DC terminals; the auxiliary DC supply means being operative to supply an auxiliary DC voltage and to cause the instantaneous magnitude of the main DC voltage to be: (i) substantially equal to the absolute instantaneous magnitude of the AC voltage as long as this absolute instantaneous magnitude is larger than a predetermined substantially fixed magnitude not larger than about 40% of the absolute peak magnitude of the AC voltage; and (ii) substantially equal to the instantaneous magnitude of the auxiliary DC voltage whenever the absolute instantaneous magnitude of the AC voltage is not higher than said predetermined substantially fixed magnitude;

such that: (i) the gas discharge liqhtinq means is operative to provide light in an uninterrupted manner; and (ii) the current drawn from the source by the full-wave rectifier is characterized by having harmonic distortion of not more than about 20%.

2. The arrangement of claim 1 wherein: (i) the inverter means is characterized by providing an inverter output voltage of frequency substantially higher than that of the AC voltage; and (ii) the gas discharge lighting means is powered from the inverter output voltage by way of a resonant L-C circuit means.

3. The arrangement of claim 2 wherein the frequency of the inverter output voltage is modulated at a modulation frequency equal to at least twice the frequency of the AC voltage.

4. The arrangement of claim 1 wherein the auxiliary DC supply means comprises an energy-storing capacitor.

5. The arrangement of claim 4 wherein the energy-storing capacitor is being periodically charged by energy provided by the inverter means.

6. An arrangement comprising:

a source of substantially sinusoidal AC voltage;

rectifier means connected with the source of AC voltage and operative to provide periodic unidirectional current pulses to a pair of DC terminals having a DC voltage thereacross; the rectifier means drawing a first alternating current from the source; the first alternating current having: (i) a first frequency, and (ii) harmonic distortion;

inverter ballasting means connected with the DC terminals and operative to provide a second alternating current to a gas discharge lamp while drawing a unidirectional current from the DC terminals; the second alternating current being of a second frequency, which is substantially higher than the first frequency; the inverter ballasting means having control input means operative in response to a control action to control the second frequency; the instantaneous magnitude of the unidirection current being a function of the second frequency; and control means connected in circuit with the control input means and the source; the control means being operative to provide the control action, thereby to cause the second alternating current to be frequency-modulated at a modulation frequency equal to the first frequency or some harmonic thereof; thereby, in turn, to control the instantaneous magnitude of the unidirectional current; thereby, in turn, controlling the degree of harmonic distortion.

7. The arrangement of claim 6 wherein the control means is responsive to the absolute instantaneous magnitude of the first alternating current.

8. The arrangement of claim 7 wherein: (i) the AC voltage has a half-cycle encompassing a total angular span of 180 degrees; and (ii) the first alternating current has an instantaneous magnitude roughly proportional to that of the AC voltage over a total angular span of at least 120 degrees out of the total angular span of 180 degrees.

9. An arrangement comprising:

a source of substantially sinusoidal AC voltage;

full-wave rectifier connected with the source of AC voltage and operative to provide periodic pulses of unidirectional current to a pair of DC terminals across which there exists a main DC voltage; the full-wave rectifier drawing an alternating current from the source of AC voltage; the alternating current having harmonic distortion;

load means connected with the DC terminals; the load means including inverter means and gas discharge lighting means; and auxiliary DC supply means connected in circuit between the inverter means and the DC terminals; the auxiliary DC supply means being operative to supply an auxiliary DC voltage and to cause the instantaneous magnitude of the main DC voltage to be: (i) substantially equal to the absolute instantaneous magnitude of the AC voltage as long as this absolute instantaneous magnitude is larger than a predetermined substantially fixed magnitude that is substantively lower than 50% of the absolute peak magnitude of the AC voltage; and (ii) substantially equal to the auxiliary DC voltage whenever the absolute instantaneous magnitude of the AC voltage is lower than said predetermined substantially fixed magnitude;

such that: (i) the gas discharge lighting means is operative to provide light in an uninterrupted manner; and (ii) the harmonic distortion is not higher than about 20%.

10. An arrangement comprising:

a source of substantially sinusoidal AC voltage; this AC voltage having a half-cycle encompassing a total angular span of 180 degrees;

full-wave rectifier connected with the source of AC voltage and operative to provide periodic pulses of unidirectional current to a pair of DC terminals across which there exists a main DC voltage; the full-wave rectifier drawing an alternating current from the source of AC voltage;

a load connected with the DC terminals; the load including inverter means and gas discharge lighting means; and auxiliary DC supply means connected in circuit between the inverter means and the DC terminals; the auxiliary DC supply means being operative to supply an auxiliary DC voltage and to cause the instantaneous magnitude of the main DC voltage to be: (i) substantially equal to the absolute instantaneous magnitude of the AC voltage as long as this absolute instantaneous magnitude is larger than a predetermined substantially fixed magnitude that is substantively lower than 50% of the absolute peak magnitude of the AC voltage; and (ii) substantially equal to the auxiliary DC voltage whenever the absolute instantaneous magnitude of the AC voltage is lower than than said predetermined substantially fixed magnitude;

such that: (i) the gas discharge lighting means is operative to provide light in an uninterrupted manner; and (ii) the instantaneous magnitude of the alternating current being approximately proportional to that of the AC voltage over more than 120 degrees out of the total span of 180 degrees.

11. The arrangement of claim 10 wherein the instantaneous magnitude of the alternating current is zero over at least 30 degrees out of the total angular span of 180 degrees.

12. An arrangement comprising:

a source of substantially sinusoidal AC voltage; this AC voltage having a half-cycle encompassing a total angular span of 180 degrees; and a load connected with the source of AC voltage; the load including rectifier means, inverter means and gas discharge lighting means; the load being operative to draw an alternating current from the source; the instantaneous magnitude of this alternating current being: (i) substantially proportional to that of the AC voltage over at least 120 degrees out of the total angular span of 180 degrees; and (ii) substantially zero over at least 30 degrees out of the total angular span of 180 degrees.

* * * * *